US012421065B2

(12) United States Patent
Pfitzenmeier et al.

(10) Patent No.: US 12,421,065 B2
(45) Date of Patent: Sep. 23, 2025

(54) SHEET FOLDING MACHINE WITH WASTE PRODUCT REMOVAL

(71) Applicant: Heidelberger Druckmaschinen AG, Heidelberg (DE)

(72) Inventors: Mario Pfitzenmeier, Bretten (DE); Michael Östreicher, Eppelheim (DE); Volker Kautz, Althengstett (DE); Udo Ganter, Freiberg am Neckar (DE); Herbert Ackermann, Ludwigsburg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 18/543,507

(22) Filed: Dec. 18, 2023

(65) Prior Publication Data

US 2024/0199356 A1 Jun. 20, 2024

(30) Foreign Application Priority Data

Dec. 20, 2022 (EP) ..... 22214842

(51) Int. Cl.
*B65H 7/12* (2006.01)
*B65H 45/14* (2006.01)

(52) U.S. Cl.
CPC ..... *B65H 7/125* (2013.01); *B65H 45/14* (2013.01); *B65H 2511/522* (2013.01); *B65H 2511/524* (2013.01); *B65H 2553/30* (2013.01)

(58) Field of Classification Search
CPC .. B65H 7/125; B65H 45/14; B65H 2511/522; B65H 2511/524; B65H 2553/30
USPC ..... 493/8, 19, 420, 421
See application file for complete search history.

(56) References Cited

U.S. PATENT DOCUMENTS 4,850,945 A * 7/1989 Whittenberger ..... B65H 45/148 493/420
5,242,364 A * 9/1993 Lehmann ..... B65H 5/025 493/15
5,246,415 A * 9/1993 Fuss ..... B65H 45/144 493/28
5,871,433 A * 2/1999 Lehmann ..... B65H 29/32 270/32

(Continued)

FOREIGN PATENT DOCUMENTS

CN 102530634 A 7/2012
CN 102627203 A 8/2012

(Continued)

*Primary Examiner* — Sameh Tawfik
(74) *Attorney, Agent, or Firm* — Laurence A. Greenberg; Werner H. Stemer; Ralph E. Locher

(57) ABSTRACT

A machine for folding sheets receives a stream of sheets. A first folding unit is followed by a further unit. The first folding unit has at least one buckle plate and at least two folding rollers to fold the sheets. A monitoring device checks the stream for defects. A control unit activates a removal device for removing waste products when a defect is detected. The monitoring device is disposed at the entry region of the buckle plate and monitors the stream in the buckle plate. The removal device is disposed downstream of the first folding unit and upstream of the further unit. The system, which is suitable for industrial folding machines, reliably detects unusable waste products in the folding process even before production might be affected.

13 Claims, 4 Drawing Sheets

(56) References Cited

U.S. PATENT DOCUMENTS

| | | | | | |
|---|---|---|---|---|---|
| 5,980,439 | A * | 11/1999 | Johnson | B65H 45/144 493/29 |
| 6,024,682 | A * | 2/2000 | Mandel | B65H 45/147 270/32 |
| 6,080,251 | A * | 6/2000 | Baker | B31F 1/0025 156/277 |
| 6,086,522 | A * | 7/2000 | Hechler | B65H 45/147 493/34 |
| 6,641,514 | B1 * | 11/2003 | Hechler | B65H 45/147 493/23 |
| 9,079,744 | B2 * | 7/2015 | Watanabe | B65H 45/142 |
| 2012/0202671 | A1 | 8/2012 | Haupt-Terlau | |
| 2016/0207303 | A1 * | 7/2016 | Nader | B31D 1/0081 |
| 2020/0122955 | A1 * | 4/2020 | Yamamoto | B65H 45/18 |

FOREIGN PATENT DOCUMENTS

| | | | |
|---|---|---|---|
| DE | 202008012564 | U1 | 12/2008 |
| DE | 102010049057 | A1 | 4/2012 |
| EP | 2489616 | A2 | 8/2012 |
| JP | 2000318921 | A | 11/2000 |
| JP | 2010111471 | A | 5/2010 |
| JP | 2016132518 | A | 7/2016 |

* cited by examiner

SHEET FOLDING MACHINE WITH WASTE PRODUCT REMOVAL

CROSS-REFERENCE TO RELATED APPLICATION

This application claims the priority, under 35 U.S.C. § 119, of European Patent Application EP22214842.1, filed Dec. 20, 2022; the prior application is herewith incorporated by reference in its entirety.

FIELD AND BACKGROUND OF THE INVENTION

The technical field of the invention is the field of the graphics industry, in particular the field of folding printing materials as well as creating and conveying of folded products, preferably made of paper.

The invention relates to a machine for folding sheets with a waste product removal device has a sheet feeder generating a stream of sheets, a first folding unit, and a further unit. The first folding unit comprises at least one buckle plate and at least two folding rollers to fold the sheets. The machine further has a monitoring device, a control unit, and a removal device. The monitoring device checks the stream for defects and the control unit activates the removal device for removing waste products when a defect is detected.

German published patent application DE 10 2010 049 057 A1 discloses a machine for folding sheets with waste product removal of this general kind, i.e., the machine comprises a sheet feeder which generates a stream of sheets, a first folding unit and a further unit, said first folding unit comprising at least one buckle plate and at least two folding rollers for folding the sheets as well as a monitoring device, a control unit, and a removal deflector, wherein the monitoring device checks the stream for defects and the control device activates the removal deflector for removing unusable products when a defect is detected. The monitoring device is disposed between the sheet feeder and the first folding unit in the region of a feed table; the document does not disclose the location of the removal device. The generated stream of sheets is a shingled stream.

Japanese published patent application JP 2000318921 A discloses a folding unit with multiple buckle folders and sensors such as photoelectric sensors, which are disposed approximately at the center relative to the length of the buckle folders. The document does not disclose the processing of a shingled stream of sheets.

Japanese published patent application JP 2016132518 A likewise discloses a folding unit with multiple buckle folders and sensors such as laser sensors, which are likewise disposed approximately at the center relative to the length of the buckle folders. Again, does not disclose the processing of a shingled stream of sheets.

The company MBO Postpress Solutions GmbH markets a transfer table disposed downstream of a first folding unit with unusable sheet removal. Misfolded sheets or double sheets may be removed. An ultrasound sensor may be used.

The company Herzog & Heymann GmbH & Co. KG likewise markets a removal deflector downstream of the folding unit. The removal deflector may be actuated by a camera system disposed upstream of the folding unit.

European published patent application EP 1013589 A2 and its counterpart U.S. Pat. No. 6,641,514 B1 disclose a buckle folding unit and a method for controlling the register of a buckle folding unit. Means for detecting a first instant during travel of a sheet from an entry into the buckle folding unit until it reaches a buckle stop, means for detecting a second instant during travel of the sheet from the formation of a fold to the exit of the buckle plate, and means for determining the sheet length conveyed between the first and second instants. No removal means are disclosed.

Japanese published patent application JP 2010111471 A discloses a machine with a buckle folding unit comprising multiple buckle plates. An endless web is provided with marks based on which the web is cut crosswise. The resultant sections are folded. The machine comprises sensors for detecting the marks. The machine further comprises a sensor for detecting unusable products and switchable means for removing unusable products that have been detected.

European published patent application EP 2489616 A2 discloses a feeder for a printing technology machine, in particular a buckle folding machine, and a method of operating such a folder. The feeder comprises a device for detecting multiple sheets. It may comprise ultrasound sensors. Since the creation of unusable products is to be avoided, no means for removing unusable products are disclosed.

Sheets that have been misfolded in a folding unit may cause problems in a downstream station, e.g., a table with oblique rollers or a further folding unit, for example due to length deviations. The production may need to be stopped.

SUMMARY OF THE INVENTION

Thus an object of the present invention is to provide an improvement over the prior art which in particular provides a way of reliably detecting and removing unusable products in a folding process even before the production run may be affected.

With the above and other objects in view there is provided, in accordance with the invention, a machine for folding sheets with waste product removal, the machine comprising:

- a sheet feeder for generating a stream of sheets;
- a first folding unit and a further unit disposed along a sheet transport direction, said first folding unit having at least one buckle plate and at least two folding rollers for folding the sheets;
- a monitoring device disposed at an entry region of said buckle plate, said monitoring device being configured to monitor the stream of sheets in said buckle plate and to check the stream for defects;
- a removal device for removing waste products disposed between said first folding unit and said further unit along the sheet transport direction; and
- a control unit connected to said monitoring device and said removal device, said control unit being configured to activate said removal device for removing a waste product when a defect is detected.

In other words, the objects of the invention are achieved by a machine for folding sheets having a waste product, i.e., unusable product removal. The machine comprises a sheet feeder generating a stream of sheets, a first folding unit, and a further unit, said first folding unit comprising at least one buckle plate and at least two folding rollers for folding the sheets as well as a monitoring device, a control unit, and a removal device, the monitoring device checking the stream for defects and the control unit activating the removal device for removing unusable products when a defect is detected and is characterized in that the monitoring device is disposed at the entry region of the buckle plate and monitors the stream in the buckle plate, and in that the removal device is disposed downstream of the first folding unit and upstream of the further unit.

Advantageous embodiments and effects of the invention will now be described in the following. The invention advantageously provides a way of reliably detecting and removing unusable products in a folding operation before they might have a detrimental effect on production.

The entry region of the buckle plate is the open front region facing the folding rollers of the folding unit. There the sheets enter the buckle plate in an entry direction one sheet edge first. There an inlet lip is preferably provided. In the rear region of the buckle plate, the sheet edges of the sheets hit a stop that is adjustable in accordance with the folding length. A middle region of the buckle plate is located between the entry region and the rear region. The entry region is also the exit region because it is where the sheets exit the buckle plate in an exiting direction (counter to the entry direction).

Studies to improve production have found that when sheets that succeed one another are folded in buckle plates, the problem may occur that a trailing sheet edge of an exiting leading (first) sheet entrains the leading edge of an entering trailing (second) sheet in the exiting direction, a phenomenon which may in particular occur in the inlet/exit region. Another problem that has been discovered is that a leading sheet edge of an entering trailing (second) sheet may entrain the trailing sheet edge of an exiting leading (first) sheet in the entering direction, a phenomenon which may likewise in particular occur in the entry/exit region. In both cases, misfolds and deviations from a target folding length may occur. The inlet/exit region may thus be understood to be the area in which two successive sheets pass each other and potentially hinder one another in their movement and/or in their direction of movement.

An advantage of the invention is that folding errors are detected at the instant and location at which they actually occur, namely: in the folding unit of a buckle folding machine, especially in a buckle plate, preferably in the first, active buckle plate, and there especially already in the inlet/exit region for the sheets to be folded. Since errors are thus detected at such an early point, measures may be taken without undesired delay. These measures preferably include the removal of unusable products immediately downstream of a folding unit, in particular in the area of a transfer device. This saves valuable time to be able to remove defective sheets even before they enter a downstream further station. In the end, this avoids production stops, reduces unusable products, increases productivity, and lowers production costs. Extremely high machine speeds as they are increasingly demanded in an industrial environment are only possible if the detection of defects likewise meets extreme requirements. The invention makes a substantial contribution to this.

The distance between the removal device and the exit of the folding unit is preferably selected in such a way that sufficient response time is provided to ensure that removal is possible even for long sheet formats and at high machine speeds.

The invention further provides an opportunity to detect various defect types and, as a function of the detection, to remove individual sheets or groups of sheets (two or more sheets). Such defect types may include, for instance: leading sheet edges (of downstream sheets) entrained (by leading sheets) in the entry region, trailing sheet edges (of leading sheets) entrained (by trailing sheets) in the entry region, and/or sheets that have been folded in an undesired way/misfolds.

The sheet feeder preferably generates a shingled stream of sheets, such as an "under-shingled stream" in which a (leading/front) part of a trailing sheet is located underneath a (trailing/rear) part of a leading sheet. This shingled stream of sheets is fed to the first folding unit. The folding operation in the first folding unit dissolves the shingled formation, i.e., the folded sheets do not exit the first folding unit as a shingled stream but as sheets that succeed one another and are preferably spaced apart from one another.

The first station is preferably a buckle folding unit with at least one buckle plate. The further station is preferably likewise a buckle folding unit and may alternatively be a blade folding unit, for example.

The following paragraphs describe preferred further developments of the invention.

In accordance with a further feature of the invention, the entry region comprises a maximum of ¼, ⅕, ⅙, or 1/10 of the length of the buckle plate. In accordance with again a further feature of the invention, the entry region may amount to a maximum of 150 mm or 130 mm or 110 mm of the length of the buckle plate. In accordance with het a further feature, the entry region comprises approximately 100 mm of the length of the buckle plate.

In accordance with an added feature of the invention, the buckle plate is selectable from a plurality of provided buckle plates of different lengths and arrangeable in the first folding unit.

In accordance with an additional feature of the invention, the buckle plate comprises an entry lip and the entry region is positioned to be close to the entry lip. A further development may be characterized in that the entry region is positioned to be adjacent to the entry lip. A further development may be characterized in that the entry lip is positioned to be close to the two folding rollers. A further development may be characterized in that the entry lip is positioned to be adjacent to at least one of the two folding rollers.

In accordance with again an added feature of the invention, at the monitoring device comprises an ultrasound sensor. A further development may be characterized in that the ultrasound sensor is of bipartite design, thus comprising an emitter and a receiver. A further development may be characterized in that the emitter and receiver are oriented to be orthogonal to the plane of the sheet to be checked.

In accordance with an additional feature of the invention, the emitter and receiver are spaced apart from one another by approximately 40 mm. A further development may be characterized in that in the checking process, the ultrasound sensor detects whether there is/are one, two, or no sheet(s) located in the buckle plate. A further development may be characterized in that the ultrasound sensor detects whether a single layer and a double layer of sheets occur in continuous alternation in the stream. In this condition, any unusable product removal device may remain deactivated. A further development may be characterized in that the ultrasound sensor detects whether a further double layer occurs in the stream within a defined period of time after a double layer. In this condition, any unusable product removal device may be activated.

In accordance with yet another feature of the invention, the monitoring device is disposed approximately at the center relative to the width of the buckle plate. This is an advantageous arrangement, especially if format widths change.

In accordance with a further feature of the invention, the monitoring device checks the stream in the buckle plate for at least one of the following defects: trailing sheets entrained by leading sheets, leading sheets entrained by trailing sheets, and/or misfolded sheets.

In accordance with yet a further feature of the invention, the stream that is fed to the first folding unit is a shingled stream, in particular what is referred to as an "under-shingled stream" where a (front) region of a trailing sheet is disposed underneath a (rear) region of a leading sheet.

In accordance with again an added feature of the invention, the removal device is disposed at a transfer device between the first folding unit and the further unit. A further development may be characterized in that the transfer device is designed as a transfer table with transport rollers. A further development may be characterized in that the further unit is a second folding unit. A further development may be characterized in that the removal device is designed as a switchable removal flap. A further development may be characterized in that the removal flap is actuated pneumatically. For this purpose, a pneumatic cylinder may be activated by a control device, which is connected to the monitoring device. A further development may be characterized in that the removal flap is disposed to pivot about a horizontal axis. A further development may be characterized in that the removal flap is closed in a first pivot position and open in a second position to remove unusable products. A further development may be characterized in that the removal flap has a first surface and in that in the first pivot position, the first surface is used as a sheet-guiding element. A further development may be characterized in that the removal flap has a second surface and in that in the second pivot position, the second surface is used as a removal element. A further development may be characterized in that the removal flap extends across the entire working width of the transfer device and is thus format-independent.

In accordance with a concomitant feature of the invention, the monitoring device comprises an optical sensor. A further development may be characterized in that the monitoring device has a reflective light sensor, a light scanner, a laser scanner, a light barrier, or a camera. A further development may be characterized in that the monitoring device comprises an ultrasound sensor and an optical sensor, preferably a reflective-light sensor, and uses both sensors for the checking operation. A further development may be characterized in that the monitoring device comprises a capacitive sensor. A further development may be characterized in that the monitoring device comprises an ultrasound sensor and a capacitive sensor and uses both sensors for the checking operation. An advantage of two sensors may be that for instance the ultrasound sensor detects approximately 90% of all defects and the further sensor, for instance the reflective-light sensor or capacitive sensor, detects the remaining 10%.

Any desired combination of the features and combinations of features disclosed in the above sections on the technical field, invention, and further developments as well as in the section below on exemplary embodiments likewise represents advantageous further developments of the invention.

Other features which are considered as characteristic for the invention are set forth in the appended claims.

Although the invention is illustrated and described herein as embodied in a machine for folding sheets with unusable product removal, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE FIGURES

In the figures, corresponding features have the same reference symbols. Repetitive reference symbols are left out in some instances for reasons of visibility.

DETAILED DESCRIPTION OF THE INVENTION

Figure 1:
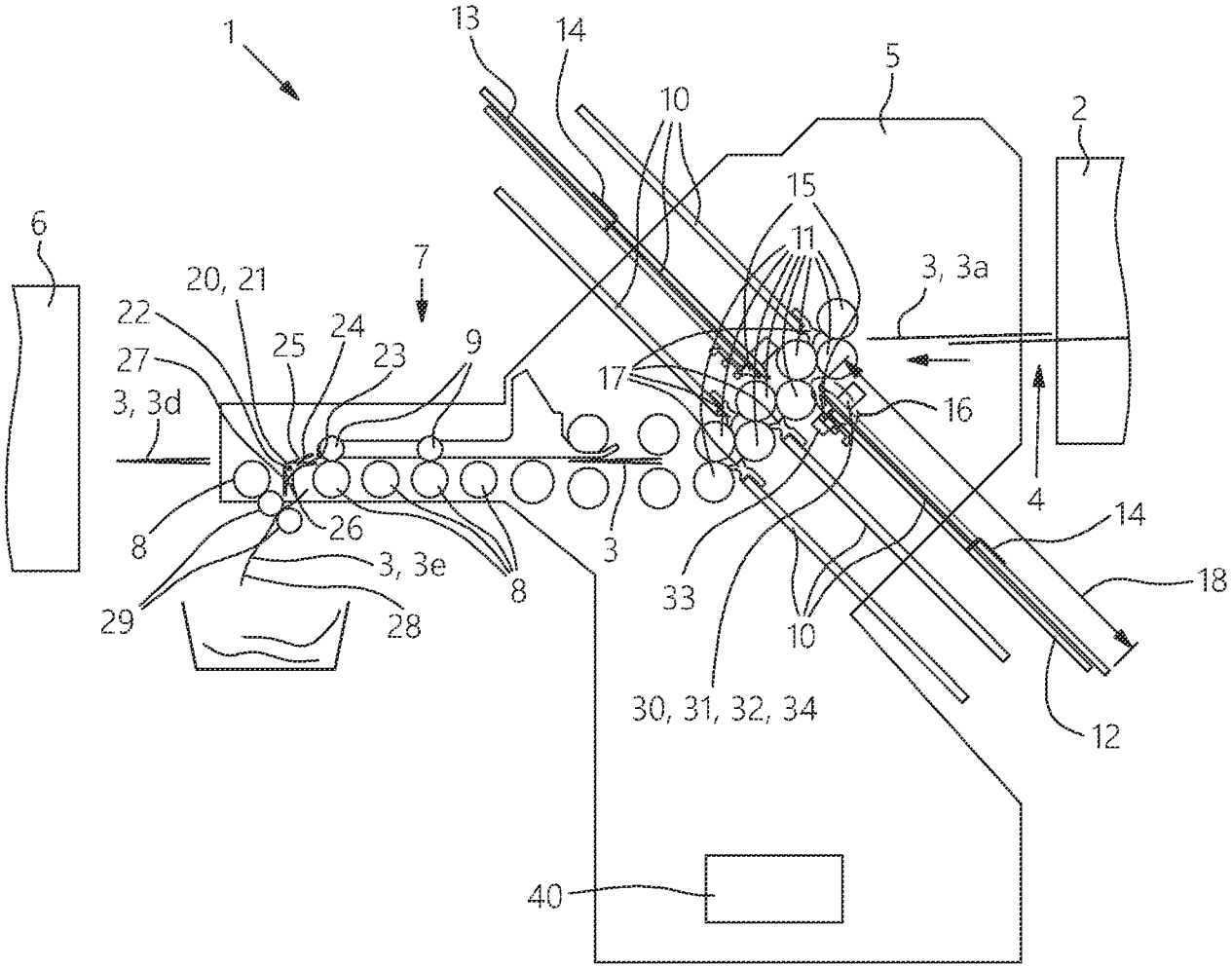
FIG. 1 is a schematic, sectional side view of an exemplary embodiment of the invention with a folding machine and waste removal.

Referring now to the figures of the drawing in detail and first, in particular, to FIG. 1 thereof, there is shown a schematic view (sectional view) of a preferred embodiment of a machine 1 for folding sheets in accordance with the invention. The machine 1 includes a sheet feeder 2 such as a stack feeder, which generates a shingled stream 4 out of sheets 3, 3*a*, such as sheets of paper or cardboard, and feeds the shingled stream to a first folding unit 5. The first folding unit 5 is preferably a buckle folding unit, which may include up to 6 buckle plates, for example. At least one second unit 6, in particular a second folding unit 6, preferably likewise a buckle folding unit, may be disposed downstream of the first folding unit 5. A transfer device 7, in particular a transfer table having multiple transport rollers 8 and a hold-down element 9, is disposed between the two folding units 5, 6.

The first folding unit 5 has multiple installation points 10 (for buckle plates or sheet deflectors installable in accordance with a folding scheme) and multiple folding rollers 11. Each one of the buckle plates 12, 13 creates a respective fold in the sheet 3. Every buckle plate 12, 13 has an adjustable folding stop 14 for adjusting the desired folding length. The sheet deflectors 17 merely deflect the sheets 3 (without folding them). Every buckle plate 12, 13 has an entry lip 15. The entry lip 15 is disposed to be close to the folding rollers 11, in particular adjacent to the folding rollers 11, and ensures that the sheet 3 enters the buckle plate 12, 13 in a trouble-free way.

The buckle plate 12 has a length 18 in the direction of the sheets entering and exiting the buckle plate; a folding stop 14 is adjustable in the direction of this length 18. The area indicated by reference numeral 16 and the dashed lines in the figure represents an entry region of the buckle plate 12. The entry region 16 is disposed to be close to the folding rollers 11, in particular adjacent to the folding rollers 11.

The machine 1 for folding sheets comprises a removal device 20, which is preferably designed as a removal flap 21 with a horizontal (pivot) axis 22. The removal flap 21 is arranged to pivot and may be pivoted back and forth between a first pivot position 23 and a second pivot position 24. The removal flap 21 preferably comprises a first surface 25 and a second surface 26, which may, for instance, be disposed at right angles relative to one another. In the first pivot position 23, all folded sheets 3*b* move across the first surface 25, whereas in the second pivot position 24, selected sheets 3*b* hit the second surface 26 and are thus removed. Thus the second surface 26 forms a removal element 27 for removing unusable products 28. Two removal rollers 29 may preferably be disposed below the removal flap 21 to assist in a secure removal of the defective sheets. They may, for instance, be driven via the last one (in the direction of transport) of the multiple transport rollers 8.

The sheets 3, 3*a* to be folded preferably enter the arrangement of folding rollers 11 as an under-shingled stream 4. There, they are folded as sheets 3, 3*b*, 3*c* by an interaction between the buckle plates 12 and the folding rollers 11, and subsequently travel along the transfer device 7 to the further unit 6 as folded sheets 3, 3*d*, i.e., not in a shingled formation.

In accordance with the invention, the machine 1 for folding sheets comprises a monitoring device 30, preferably an ultrasound sensor 31 with an emitter 32 and a receiver 33. In accordance with the invention, the monitoring device 30 is disposed at the entry region 16, preferably in the entry region 16. The monitoring device 30 may, for instance, be disposed to be close or even very close to the folding rollers 11. In the form of an ultrasound sensor 31, the monitoring device 30 may be disposed in such a way that the emitter 32 is disposed above the buckle plate 12 and the receiver is disposed below the buckle plate 12—or vice versa. Alternatively, a reflective-light sensor 34 might be provided, for instance, which is preferably disposed to be perpendicular to the plane 35 of the sheet 3.

The monitoring device 30 may detect, for instance, whether there is one sheet 3, 3*b*, 3*c* or no sheet 3, 3*b*, 3*c* or whether there are two sheets 3, 3*b*, 3*c* in the entry region 16, in particular whether there is a single layer 36 of sheets 3 or a double layer 37 of sheets 3. The detected number of sheets 3, in particular their sequence in time, may then be compared to a defined number of sheets or sequence of sheets. If there is a match, the sheets 3 may be transferred to the further unit 6 as sheets 3*d*, i.e., the removal device remains inactive (first pivot position 23). In any other case, i.e., if there is no match, i.e., in case of a defect, the sheets 3 that have been found to be defective may be removed as sheets 3*e*, i.e., as unusable products. For this purpose, the machine 1 for folding sheets comprises a control unit 40, which is connected to the monitoring device 30 in such a way that the control unit 40 actuates, i.e., pivots, the removal device 20 in a case-by-case way.

Figure 2A:
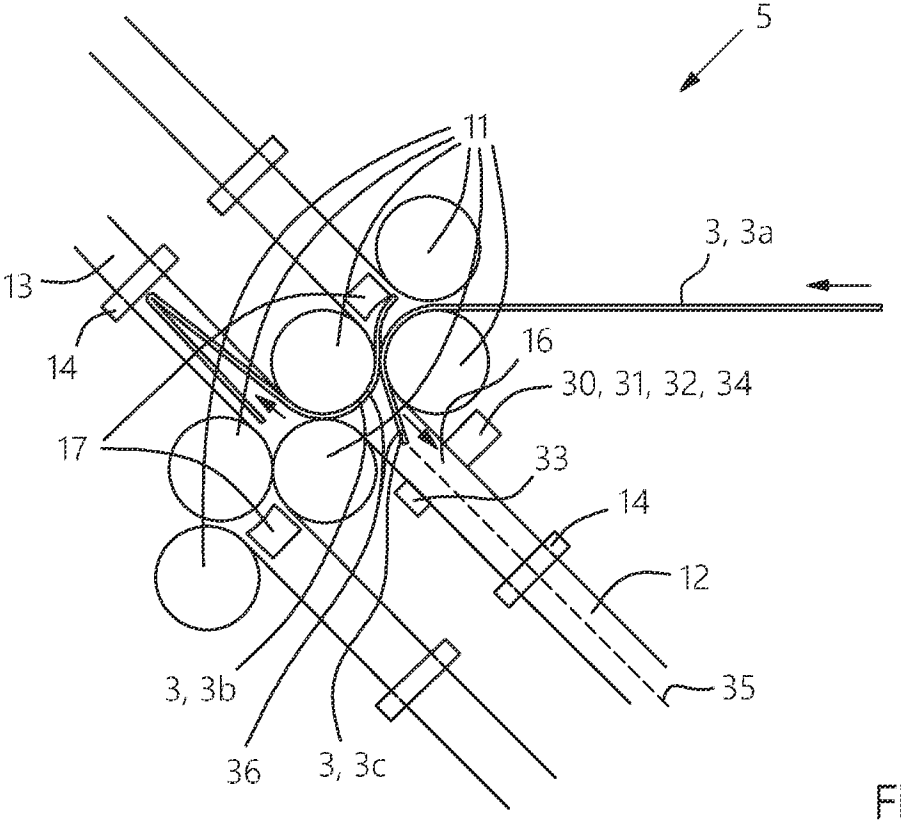
FIGS. 2A to 2C illustrate a preferred exemplary embodiment of the invention and of the further developments.
Figure 2B:
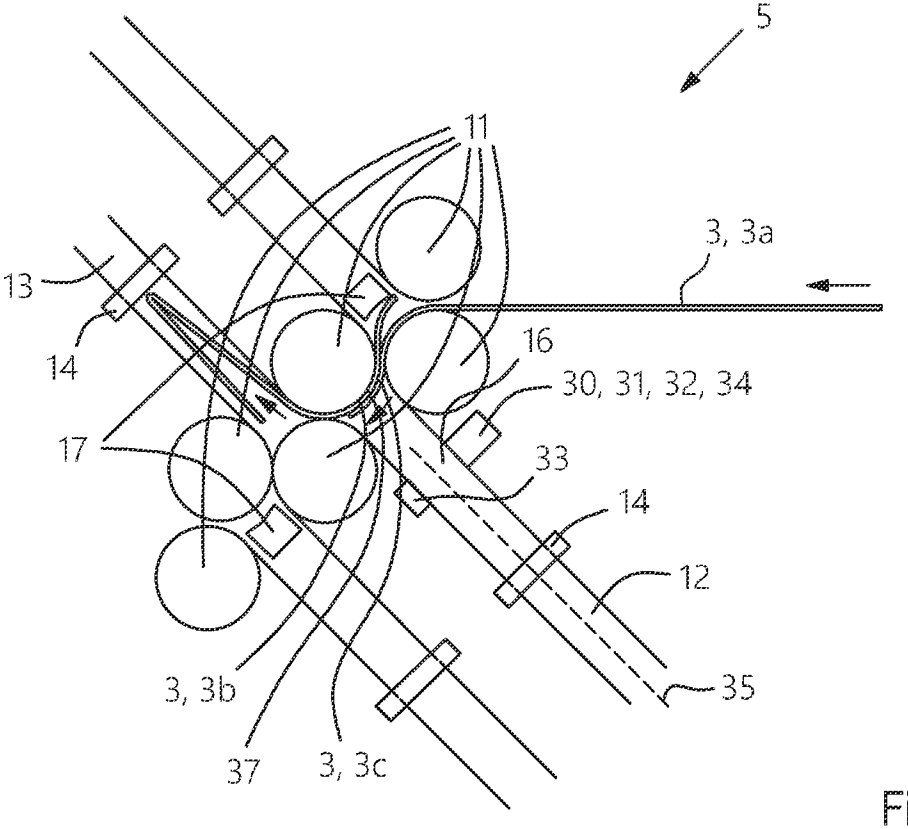
Figure 2C:
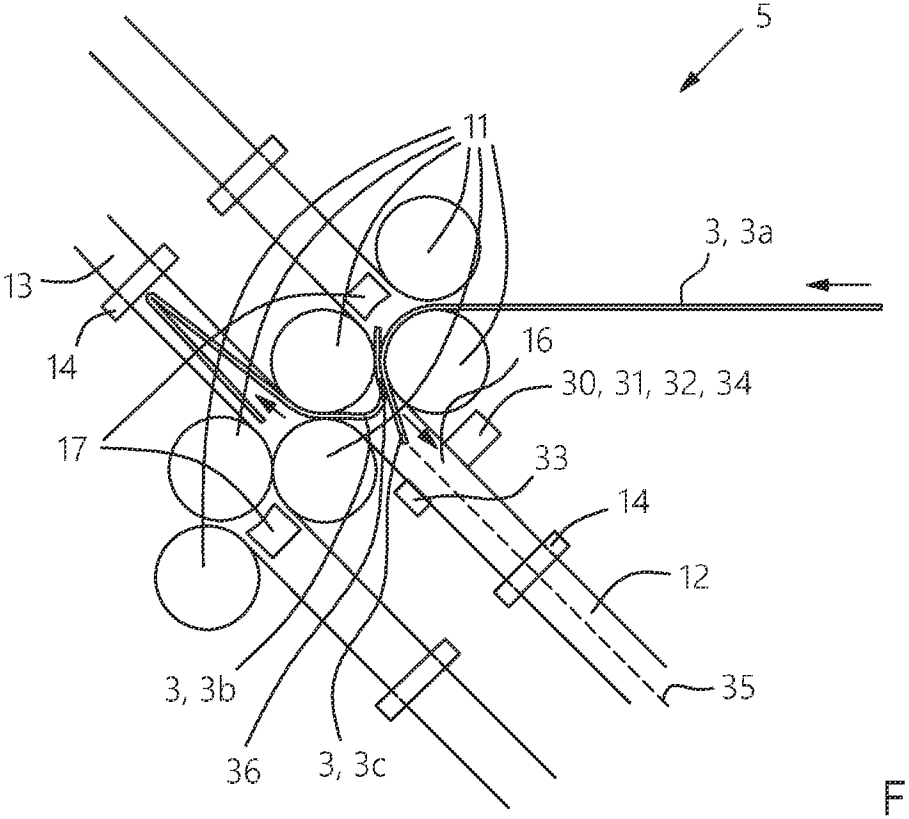

FIGS. 2A to 2C illustrate respective details of FIG. 1 in the region of the folding rollers 11 and of the buckle plates 12, 13. The detail views illustrate various states.

FIG. 2A illustrates a first state where none of the sheets 3*b* or 3*c* are entrained by the respective other sheet. The trailing edge of the leading sheet 3*b* is guided around one of the folding rollers 11 and subsequently enters the further buckle plate 13. The leading edge of the trailing sheet 3*c* enters the entry region 16, i.e., the buckle plate 12. In this state, folded products without any defects are produced. In this process, the monitoring device 30 checks the entry region 16 of the buckle plate 12, i.e., a sheet 3 in a plane 35. The monitoring device detects a defect-free production of folded products and therefore does not activate the removal device. In FIGS. 2B and 2C, this is different.

FIG. 2B illustrates a second state in which the leading edge of the trailing sheet 3*c* is entrained in the exiting direction by the trailing edge of the leading sheet 3*b*. Thus the trailing sheet 3*c* does not properly enter the entry region 16, i.e., the buckle plate 12. In this state, defective folds occur. The monitoring device 30 in turn checks the entry region 16 and detects the defective production of folded products. Thus in this condition, the unusable product removal device is activated so as to remove the waste product from the product stream.

FIG. 2C illustrates a third state in which the trailing edge of the leading sheet 3*b* is entrained in the entry direction by the leading edge of the trailing sheet 3*c*. Consequently, sheet 3*b* does not enter the second buckle plate 13 in the desired way. In this condition, too, defective folds occur. The monitoring device 30 in turn checks the entry region 16 and detects the defective production of folded products. Thus in this case, the unusable product removal device is activated as well.

In all three states, the monitoring device 30 preferably detects whether there is one sheet or no sheet or whether there are two sheets in the entry region 16. In a particularly preferred embodiment, the monitoring device 30 uses an ultrasound sensor 31 with an emitter 32 and a receiver 33. The detected number of sheets in the entry region 16 may be compared to a target value as an actual value. The target value may be defined in accordance with the ongoing production of folds as a succession of changing values (sheet number/single layer 36 or double layer 37 of sheets).

The entrainment may be caused by the following: In the folding operation, once the fold has successfully been completed, the leading sheet 3*b* exits the buckle plate 12. At the same time, the trailing sheet 3*c* enters the buckle plate 12. The leading edge of the trailing sheet meets the surface of the leading sheet. In the entry region 16 of the buckle plate, the two sheets 3*b* and 3*c* traveling in opposite directions touch and friction occurs between them along a certain path. This touching may cause defects: for instance, the trailing sheet 3*c* may be pulled out of the buckle plate and entrained by the leading sheet due to friction forces that are too high or due to damage to the paper.

The following is a summary list of reference numerals and the corresponding structure used in the above description of the invention:

1 machine for folding sheets
2 sheet feeder
3 sheet
3*a-e* sheet
4 shingled stream
5 first folding unit
6 further unit, in particular second folding unit
7 transfer device, in particular transfer table
8 transport rollers
9 hold-down element
10 installation locations for buckle plates or sheet deflectors
11 folding rollers
12 buckle plate
13 further buckle plate(s)
14 folding stop
15 entry lip
16 entry region
17 sheet deflector
18 length of the buckle plate
20 removal device
21 removal flap
22 horizontal axis
23 first pivot position
24 second pivot position
25 first surface
26 second surface
27 removal element
28 unusable product
29 removal rollers

30 monitoring device
31 ultrasound sensor
32 emitter
33 receiver
34 reflective-light sensor
35 plane of the sheet
36 individual layer of sheets
37 double layer of sheets
40 control unit

The invention claimed is:

1. A machine for folding sheets with waste product removal, the machine comprising:

a sheet feeder for generating a stream of sheets;

a first folding unit and a further unit disposed along a sheet transport direction, said first folding unit having at least one buckle plate and at least two folding rollers for folding the sheets, said buckle plate being on a given side of said at least two folding rollers;

a monitoring device disposed at an entry region of said buckle plate on said given side, said monitoring device to monitor the stream of sheets in said buckle plate and to check the stream for defects;

a removal device for removing waste products disposed between said first folding unit and said further unit along the sheet transport direction; and a control unit connected to said monitoring device and said removal device, said control unit to activate said removal device for removing a waste product when a defect is detected.

2. The machine according to claim 1, wherein said buckle plate comprises an entry lip and said entry region is positioned in vicinity to said entry lip.

3. The machine according to claim 2, wherein said entry lip is positioned in vicinity to said two folding rollers.

4. The machine according to claim 1, wherein said monitoring device comprises an ultrasound sensor.

5. The machine according to claim 4, wherein said ultrasound sensor, in a monitoring operation, is set up to detect whether there is one sheet, two sheets, or no sheet in the buckle plate.

6. The machine according to claim 4, wherein said ultrasound sensor is configured to detect whether a single layer and a double layer of sheets occur in continuous alternation in the stream.

7. The machine according to claim 6, wherein the ultrasound sensor is configured to detect whether a further double layer of sheets occurs in the stream within a specified period of time.

8. The machine according to claim 1, wherein said monitoring device is configured to check the stream in said buckle plate for at least one defect selected from the group consisting of trailing sheets entrained by leading sheets, leading sheets entrained by trailing sheets, and misfolded sheets.

9. The machine according to claim 1, wherein said removal device is disposed on a transfer device between said first folding unit and said further unit.

10. The machine according to claim 9, wherein said removal device is a switchable removal flap.

11. The machine according to claim 1, wherein said further unit is a second folding unit.

12. The machine according to claim 1, wherein said monitoring device comprises an optical sensor or a capacitive sensor.

13. The machine according to claim 1, wherein said monitoring device comprises a reflective-light sensor and/or an ultrasound sensor.

* * * * *